US006305620B1

(12) United States Patent
Marchese

(10) Patent No.: US 6,305,620 B1
(45) Date of Patent: Oct. 23, 2001

(54) FIREFIGHTING MONITOR APPARATUS

(76) Inventor: Antonio B. Marchese, 1886 NE. 29th St., Ocala, FL (US) 34479

( * ) Notice: Subject to any disclaimer, the term of this patent is extended or adjusted under 35 U.S.C. 154(b) by 0 days.

(21) Appl. No.: 09/591,940

(22) Filed: Jun. 12, 2000

(51) Int. Cl.[7] ..... B05B 15/08

(52) U.S. Cl. ..... 239/587.1; 239/280; 239/280.5; 239/525; 239/550; 239/565; 239/587.2; 239/587.5; 239/587.3; 239/587.4; 169/51; 169/52; 169/18; 169/25

(58) Field of Search ..... 239/280, 280.5, 239/525, 548, 550, 565, 587.1, 587.2, 587.3, 587.4, 587.5; 169/51, 52, 24, 25, 16, 18

(56) References Cited

U.S. PATENT DOCUMENTS

| | | | | |
|---|---|---|---|---|
| 255,430 | * | 3/1882 | Holland, Jr. | 169/25 X |
| 557,799 | | 4/1896 | Gorter . | |
| 1,102,354 | | 7/1914 | Pougnet . | |
| 2,111,553 | | 3/1938 | Chew . | |
| 2,342,757 | | 2/1944 | Roser . | |
| 3,575,060 | * | 4/1971 | Warren | 239/587.2 |
| 4,183,410 | * | 1/1980 | Dion-Biro | 169/25 |
| 4,674,686 | * | 6/1987 | Trapp | 239/280.5 X |
| 4,793,557 | | 12/1988 | Marchese et al. . | |
| 4,801,090 | * | 1/1989 | Yoshida et al. | 169/16 |
| 5,425,505 | | 6/1995 | Jones . | |

* cited by examiner

*Primary Examiner*—David A. Scherbel
*Assistant Examiner*—Robin O. Evans
(74) *Attorney, Agent, or Firm*—William M. Hobby, III

(57) ABSTRACT

A fire fighting monitor apparatus has a casing having a main inlet pipe for receiving water under pressure from a water source and a plurality of outlet arms extending from the inlet pie. Each of the outlet arms has an elbow formed therein. The casing has a main rotary joint formed therein for rotating the casing and the plurality of outlet arms. Each outlet arm has an outlet arm rotary joint therein positioned between the main inlet pipe and the outlet arm elbow for rotating a portion of each casing outlet arm. A swiveling nozzle is coupled to each outlet arm for directing water from each outlet arm separately. Each swiveling nozzle has a ball joint having a passageway therethrough and having a threaded collar thereover for tightening the swiveled nozzle into any outlet position desired. The main rotary joint has an annular rack gear engaging a worm gear having a handle thereon for rotating the main inlet pipe and the plurality of outlet nozzles. Each outlet arm rotary joint has an annular rack gear engaging a worm gear which annular gear has a handle mounted thereon for rotating each outlet arm to rotate the swiveling nozzle of each outlet arm so that a fire fighting monitor allows separate fluid streams of controlled water dispersion patterns to provide greater control of the output from the fire fighting monitor.

3 Claims, 2 Drawing Sheets

FIREFIGHTING MONITOR APPARATUS

BACKGROUND OF THE INVENTION

The present invention is directed towards a fire fighting monitor and especially to a monitor having a plurality of outlets and nozzles thereon which can direct a plurality of separate streams of fluid onto a fire.

In the past, a variety of monitors have been provided for use by firemen for controlling the flow of water onto a fire. Typical monitors are either permanently fixed on a fire truck or are sometimes portable. All monitors provide for connection to a fire hydrant or other water source and then for directing the flow of water through a single outlet having a nozzle attached thereto for directing water onto a fire. Monitors provide for the rotation thereof to enable directing the spray onto a fire. A typical monitor provides for rotating the monitor on its base through a 360° circle and then for moving the monitor through an up and down pattern so that the nozzle can be directed in any direction desired from the fire truck.

In contrast to prior art monitors, the present invention is directed towards a monitor having plural outlets and nozzles, each one having a circular swivel joint to provide flexibility in directing each nozzle separately and also allowing each nozzle to have a separate dispersion control and all of which nozzles can be controlled by one fireman simultaneously while being directed at one or more separate fires. This application is an improvement over my prior U.S. Pat. No. 4,793,557 for a Firefighting Monitor and improves the operation and control of the spray nozzles.

Typical, prior art nozzles for fire fighting can be seen in the following U.S. patents.

In U.S. Pat. No. 4,183,410 to Dion-Biro, a fire fighting nozzle assembly has two discharged conduits and can be rotated on its base with two separately controlled discharge conduits.

In the U.S. Pat. to Roser No. 2,342,757, a nozzle for use in placer mining, firefighting, or spraying with water is illustrated having two swivelable nozzles mounted to a spherical terminal member and allows the nozzles to be swiveled in a variety of directions on the spherical terminal member. In the Gorter U.S. Pat. No. 557,799, an adjustable nozzle for hose pipes is used for handling a stream of water for firefighting purposes and uses a ball joint to permit the nozzle to be moved in different directions. The Chew U.S. Pat. No. 2,111,553 is a monitor or mining nozzle for connection with a high pressure water supply. The Pougnet U.S. Pat. No. 1,102,354 is an apparatus for the discharge of water or other liquids in a spray over a comparatively large area and uses a plurality of outlet nozzles from a common supply source. The Jones U.S. Pat. No. 5,425,505 is a portable ground standing fire fighting monitor which has a support platform intended to be placed horizontally on the ground and has a water gun with a curved flexible inlet tube having an inlet end and a curved discharge head having an outlet end. A water tight ball bearing swivel joint couples the discharge head to the curved flexible tube and a crank wheel is rotated to enable the swiveling discharge head to be swiveled from side-to-side.

The present invention is an improvement over my prior patent for a fire fighting monitor apparatus No. 4,793,557 and provides a plurality of discharge nozzles each mounted on a swivel nozzle head which can be rapidly adjusted. Further control is provided by the rotation of each discharge outlet arm. Each outlet arm has an elbow therein so that when the arm is rotated, the nozzles are rotated for vertical adjustment of the spray. Each arm is rotated with a hand crank to allow for movement while in use.

SUMMARY OF THE INVENTION

A fire fighting monitor apparatus has a casing having a main inlet pipe for receiving water under pressure from a water source and a plurality of outlet arms extending from the main inlet pipe. Each of the outlet arms has an elbow formed therein. The casing has a main rotary joint formed therein for rotating the casing and the plurality of outlet arms. Each outlet arm has an outlet arm rotary joint therein positioned between the main inlet pipe and the outlet arm elbow for rotating a portion of each casing outlet arm. A swiveling nozzle is coupled to each outlet arm for directing water from each outlet arm separately. Each swiveling nozzle has a ball joint having a passageway therethrough and having a threaded collar thereover for clamping the swiveled nozzle onto a predetermined outlet position. The main rotary joint has an annular rack gear engaging a worm gear having a handle thereon for rotating the main inlet pipe and the plurality of outlet nozzles. Each outlet arm rotary joint has an annular rack gear engaging a worm gear which annular gear has a handle mounted thereon for rotating each outlet arm to rotate the swiveling nozzle of each outlet arm so that a fire fighting monitor allows separate fluid streams of controlled water dispersion patterns to provide greater control of the output from the fire fighting monitor.

BRIEF DESCRIPTION OF THE DRAWINGS

Other objects, features, and advantages of the present invention will be apparent from the written description and the drawings in which.

DESCRIPTION OF THE PREFERRED EMBODIMENT

Figure 1:
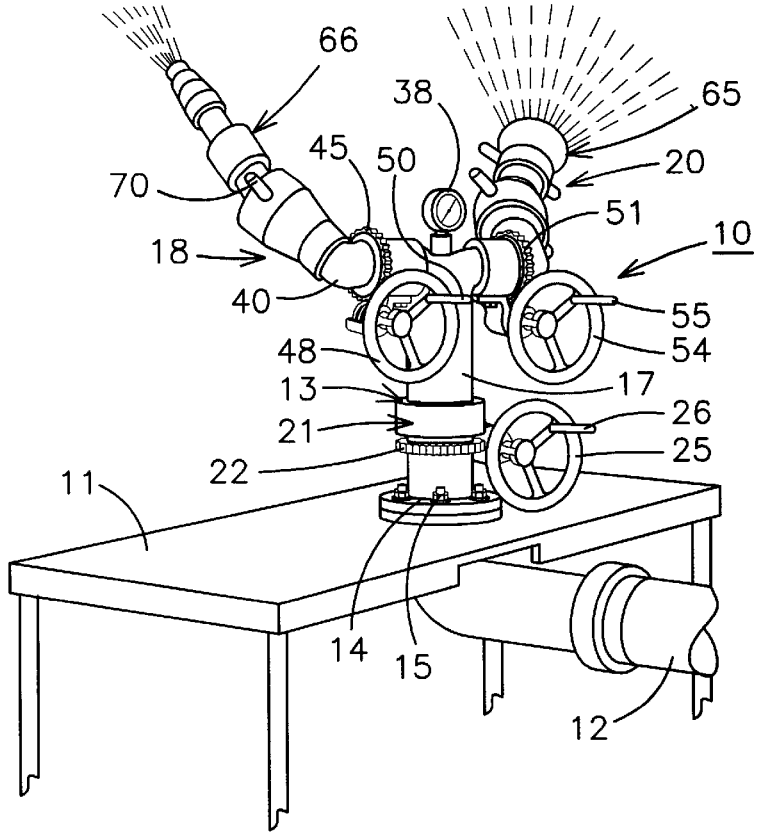
FIG. 1 is a perspective view of a preferred embodiment of the present invention mounted to a surface.
Figure 2:
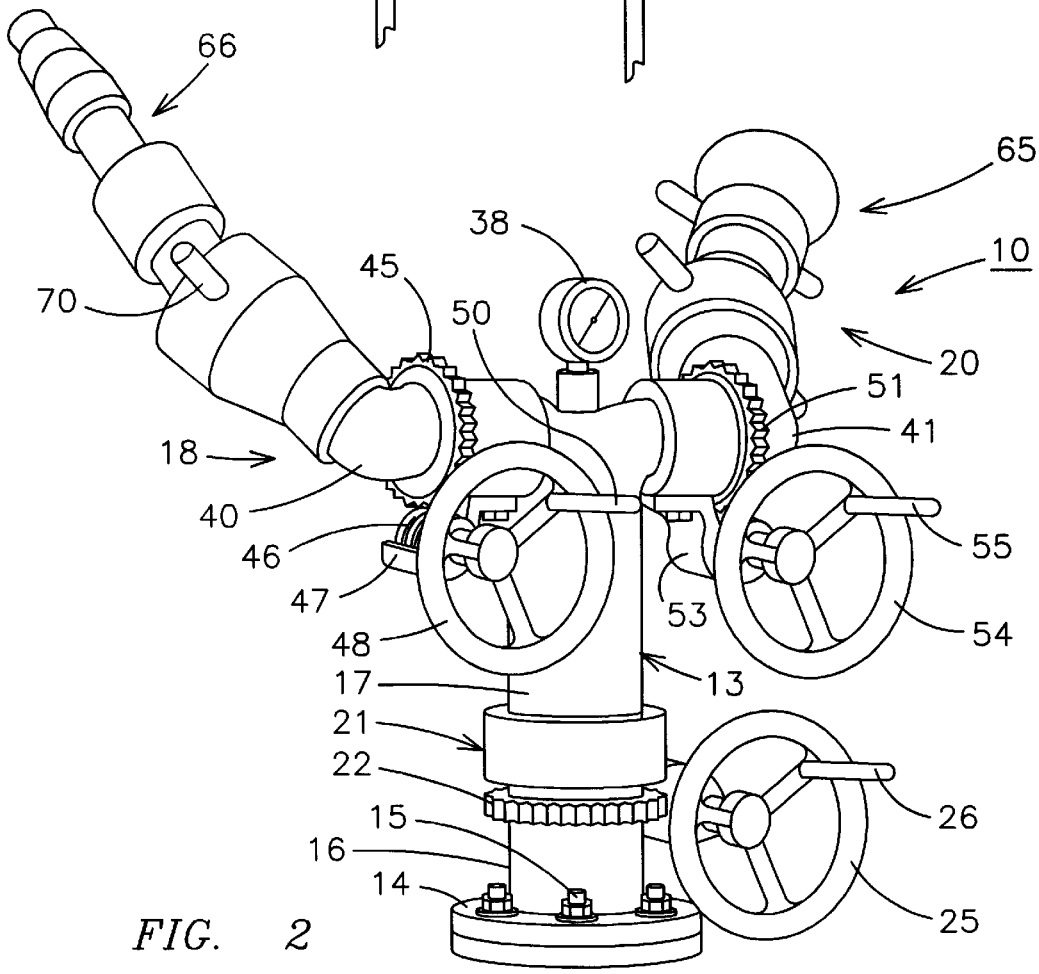
FIG. 2 is a perspective view of a fire fighting monitor of FIG. 1.

Referring to the drawings, FIGS. 1–4, a fire fighting monitor 10 is illustrated mounted to a base 11 in FIG. 1 and having an inlet water pipe 12 entering from the bottom of the base 11. The base 11 is a portable stand so that the fire fighting monitor can be placed at any position desired but the monitor is normally attached to a fire truck. Fire monitor 10 has a casing 13 having a flanged base 14 having bolts 15 mounted therethrough to attach the monitor 10 to a base 11. Casing 13 has a fixed center pipe 16 and a rotary center pipe 17. Casing 13 also includes two arms 18 and 20. The case 13 fixed center pipe 16 is connected to the rotary center pipe 17 with a rotary joint 21 and is connected to a rack gear 22 which meshes with a worm gear 23 which is covered by a hooded worm housing 24. The worm housing 24 can be fully enclosed if desired. The worm gear 23 is connected to a handwheel 25 having a handle 26 thereon so that rotating the handle 25 rotates the worm gear 23 to rotate the annular rack gear 22 to rotate the rotatable center pipe 17 on the rotary joint 21.

Figures 3, 4:
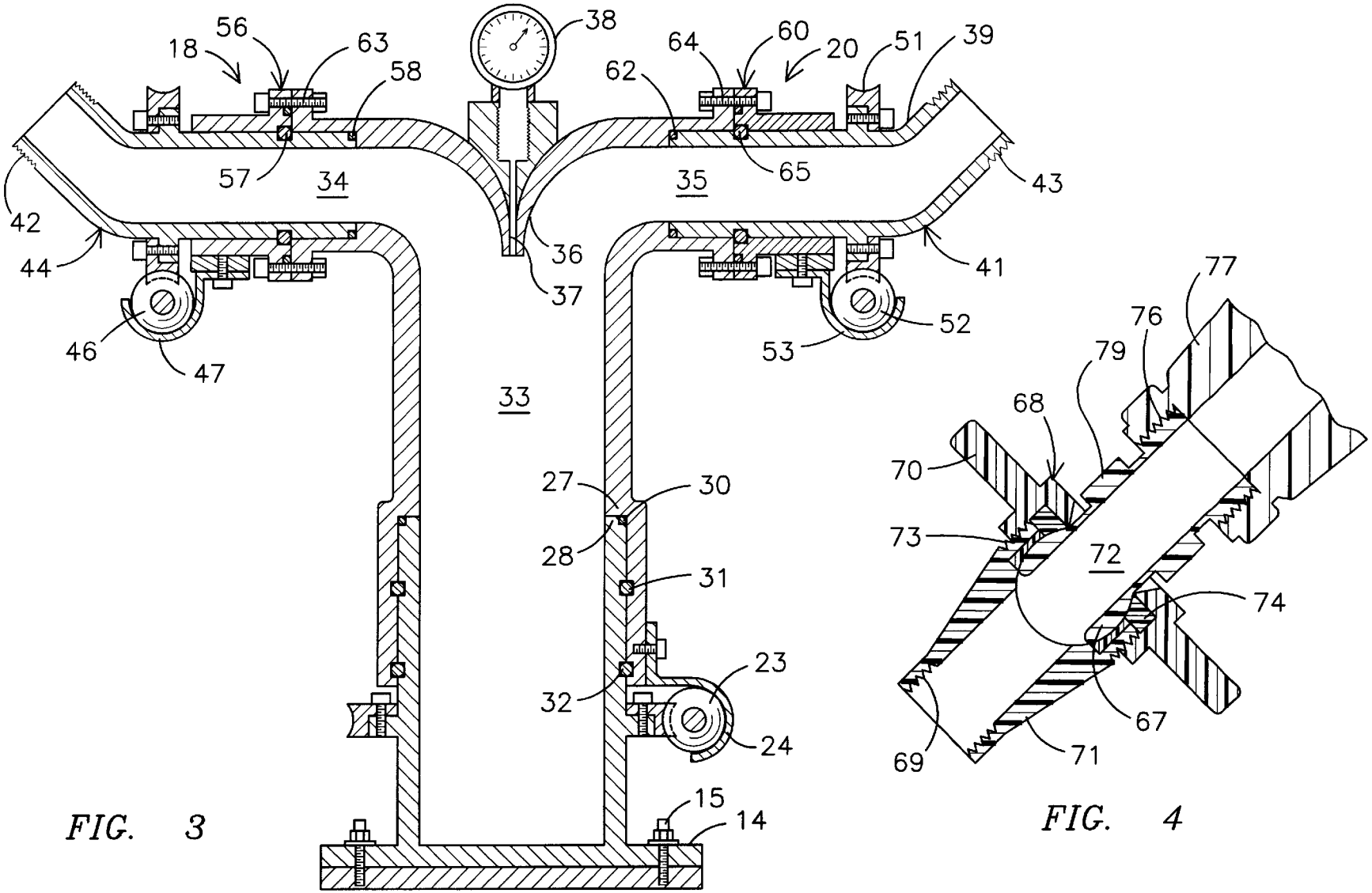
FIG. 3 is a sectional view of the fire fighting monitor of FIGS. 1 and 2 without the swiveling nozzles attached thereto.
FIG. 4 is a sectional view of one attached swiveling nozzle of the fire fighting monitor of FIGS. 1–3.

As seen in FIG. 3, the rotary joint 21 rotary center pipe 17 has a ledge 27 riding on the top edge 28 of the fixed center pipe 16 and has seals 30, 31 and 32 placed in seal grooves positioned between the fixed center pipe 16 and the rotary center pipe 17. This arrangement allows for the rapid rotation of the rotary center pipe 17 and the arms 18 and 20 by the rotation of the handwheel 25.

As seen in FIG. 3, the water passes through the main inlet 33 to the casing 13 and is divided between the arm 18 passageway 34 and the arm 20 passageway 35 with a water flow divider 36. The water flow divider section has a tube 37 connecting to a pressure gauge 38 mounted to the casing 13 between the arms 18 and 20. The arm 18 has an elbow 44 therein while the arm 20 has an elbow 39 therein. The arm 18 also has exterior threads 42 for attaching a nozzle thereto while the arm 20 has external threads 43 for attaching a nozzle thereto. Arm 18 has a rotary arm portion 44 having a rack gear 45 meshing with a worm gear 46 covered by hooded worm housing 47. The worm gear 46 is connected to a handwheel 48 having a handle 50 so that rotating the handwheel 48 rotates the rotatable arm portion 44. Similarly, the arm 20 rotating arm portion 41 has an annular rack gear 51 connected to a worm gear 52 covered by a hooded worm housing 53. The worm gear 52 is connected to a handwheel 54 having a handle 55 so that rotating the handle 54 rotates the worm gear 52 to rotate the rotatable arm portion 41. The arm 18 has a rotatable joint 56 having seals 57 and 58 therein while the rotatable joint 60 on the arm 20 has seals 61 and 62 therein. The seals 57 and 65 also lock the rotatable arm to the fixed portion of the arms and are bolted to lock the rotary arm to the fixed arm with bolts 63 on arm 18 and 64 on arm 20.

Thus, both arms can be simultaneously rotated by rotating the handwheel 25 to rotate the casing 13 rotary center pipe 17 which rotates both arms simultaneously while rotating the handwheels 48 and 54 rotates the rotatable portion of the arms 18 and 20 in a direction perpendicular to the rotation of the center pipe 17. The use of the elbows 44 on arm 18 and 39 on arm 20 assures that each nozzle is being rotated through an angular positioning relative to the rotation of the center pipe 17. The arm 20 in FIGS. 1 and 2 has a spray nozzle 65 attached thereto while the arm 18 has a directional nozzle 66 attached thereto.

Each nozzle, as seen in FIG. 4, has a ball joint 67 which has a threaded collar 68 having a handle 70 thereon with a nozzle portion 71 fitting over the ball joint portion 67 which has a passageway 72 passing therethrough. The collar 68 is threaded onto the threads 73 against an annular seal 74 to seal the nozzle 71 onto the ball joint 67. A nozzle head 77 is attached to the ball joint extension 79 with the threads 76. The nozzle head 77 can be for a wide dispersion spray or for a more directional spray as desired. The nozzle assembly of FIG. 4 is attached with internal threads 69 to the external threads 43 of the monitor.

Once the fire monitor 10 is set up, the nozzle 65 and 66 can be rapidly changed to any type of nozzle desired, such as a spray nozzle 65 or a more directional nozzle 66, and both nozzles can be rotated by the rotation of the handwheel 25 to rotate the center casing to any position desired while the rotation of the handwheels 48 and 54 can be used to rotate the arms 18 and 20 to any vertical position desired. Each nozzle 65 and 66 can be rapidly adjusted for rotation of the ball joint 67 where it can be tightened down to stay in any position. The fire monitor thus allows for universal adjustment while simultaneously displaying a plurality of outlet nozzles with different water patterns and quickly changeable nozzles.

I claim:

1. A fire fighting monitor comprising:

a casing having a main inlet pipe for receiving water under pressure from a water source and a plurality of outlet arms extending from said main inlet pipe, each of said casing outlet arms having an elbow formed therein and said casing having a main rotary joint formed therein for rotating said plurality of outlet arms and said main rotary joint having an annular rack gear engaging a worm gear which worm gear has a handwheel attached thereto for rotating said main rotary joint and each said outlet nozzle, and each said outlet arm having an outlet arm rotary joint therein positioned between said main inlet pipe and each said outlet arm elbow for rotating a portion of each said casing outlet arm and each said outlet arm rotary joint having an annular rack gear engaging a worm gear which worm gear has a handwheel mounted thereto for rotating each said outlet arm and a swiveling nozzle mounted thereon for rotating said swiveling nozzle;

the swiveling nozzle attached with a swiveling nozzle coupling to each said outlet arm for directing water from each outlet arm separately, each said swiveling nozzle being separately controlled for directing water therefrom in separate output directions, each said swiveling nozzle having a ball joint having a passageway therethrough and having a threaded collar thereover for tightening said swiveling nozzle coupling into a predetermined outlet position whereby the fire fighting monitor allows separate fluid streams of controlled water dispersion patterns to provide greater control of the output from the fire fighting monitor; and said casing having a pressure gauge mounted thereto for measuring the water pressure in said casing.

2. A fire fighting monitor in accordance with claim 1 in which each said swiveling nozzle ball joint has an annular seal therearound positioned between said threaded collar and said ball joint.

3. A fire fighting monitor in accordance with claims 2 in which each said swiveling nozzle threaded collar has a pair of handles thereon for use in loosening and tightening of said collar on said ball joint.

* * * * *